United States Patent [19]

Knibbs

[11] 4,251,948

[45] * Feb. 24, 1981

[54] MODEL FIGURES

[76] Inventor: Robin K. Knibbs, 18 Roman Rd., Southwick, Sussex, England

[ * ] Notice: The portion of the term of this patent subsequent to Aug. 16, 1994, has been disclaimed.

[21] Appl. No.: 824,509

[22] Filed: Aug. 15, 1977

Related U.S. Application Data

[63] Continuation of Ser. No. 635,799, Nov. 28, 1975, Pat. No. 4,041,638.

[51] Int. Cl.[3] ..... A63H 13/00

[52] U.S. Cl. ..... 46/127

[58] Field of Search ..... 46/108, 227, 127, 147, 46/149

[56] References Cited

U.S. PATENT DOCUMENTS

| | | | |
|---|---|---|---|
| 1,561,665 | 11/1925 | Richman | 46/108 |
| 2,034,325 | 3/1936 | Brady | 46/127 |
| 2,783,585 | 3/1957 | Kahl | 46/221 |

FOREIGN PATENT DOCUMENTS

| | | | |
|---|---|---|---|
| 333562 | 3/1921 | Fed. Rep. of Germany | 46/108 |

*Primary Examiner*—F. Barry Shay

*Attorney, Agent, or Firm*—Basile, Weintraub & Hanlon

[57] ABSTRACT

A model figure representing a horse and rider and consisting basically of two pivotally interconnected parts, each of which is an integral unit, formed, for example, of moulded plastic material. In one embodiment of the invention one of the parts is constituted by the arms of the rider and the majority of the horse, apart from the shoulders and fore legs. The hind legs may be formed integrally with this part or they may be pivotally attached to it. The second part of the model in this embodiment consists of the shoulders of the horse and the whole of the rider, apart from the arms. The fore legs may be formed integrally with this second part or they may be pivotally attached thereto. In a second embodiment of the invention, the first part of the model consists of the body and arms of the rider, together with the majority of the horse, while the other part of the model consists of the rider's legs, together with the shoulders of the horse. Once again, the hind legs may be integral with the first part of the model or may be pivotally attached thereto and the fore legs may be integral with the second part of the model or may be pivotally attached thereto. In any embodiment in which the fore legs are pivotally attached, a mechanical linkage is preferably provided between the fore legs and the first part of the model, so that movement of the fore legs is controlled by relative movement of the first and second parts of the model.

1 Claim, 24 Drawing Figures

MODEL FIGURES

Figure 1:
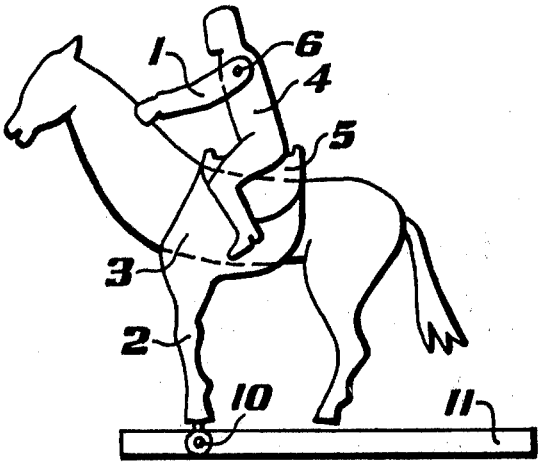

This is a continuation application of copending U.S. Pat. application Ser. No. 635,799 filed Nov. 28, 1975 now U.S. Pat. No. 4,041,638.

This invention relates to model figures representing a horse and rider.

It is an object of the invention to provide a model figure of a horse and rider, in which the motion of the horse and rider during riding can be simulated. This simulated motion can be produced by forces applied manually or by means of an internal or external mechanism, but the invention will be described primarily with reference to manually-operated models.

The invention consists in a model figure representing a horse and rider, wherein at least one part of the figure is pivotally connected to another part of the figure, wherein said one part represents a first portion of the rider and a first portion of the horse, while said other part represents a second portion of the rider and a second portion of the horse, wheren the pivotal connection between said one part and said other part is located at the junction between said first and said second portions of the rider, wherein said other part is mounted on a base, and wherein the arrangement is such that acceleration of said base in a direction having a component perpendicular to the axis of said pivotal connections produces relative angular motion of said one part with respect to said other part about said axis.

In one particular embodiment of the invention, the first portion of the rider is constituted by his arms, while the first portion of the horse is constituted by the head, the body, the hind legs and the tail of the horse. In this case, the second portion of the rider is constituted by his head, body and legs, while the second portion of the horse is constituted by the fore legs and shoulders of the horse. In this embodiment, the pivotal connection between the one part and the other part of the figure is located at the junction between the arms and the body of the rider.

In a modification of the embodiment of the invention referred to in the preceding paragraph, the hind legs of the horse are pivotally connected to the horse's body. Alternatively, or in addition, the fore legs of the horse may be pivotally connected to the horse's shoulders. If desired, each of the parts representing the legs of the horse may be constituted by two parts pivotally interconnected at a point representing the knee of the respective leg. The legs may swing freely about their respective pivotal connections, but preferably at least the fore legs are constrained to perform predetermined movements by mechanical couplings. It is to be understood that, if the leg concerned is pivotally connected to said other part of the model, the desired movement may be produced by means of a mechanical coupling to the said one part of the model.

The means for mounting the said other part of the figure on the base may be constituted by the fore legs of the horse when these are an integral part of the second portion of the horse, or may be constituted by a separate longitudinally extending support when the fore legs are pivotally connected to the horse's shoulders. In either case, there is preferably a pivotal connection between the mounting means and the base. This pivotal connection may be spring-biased towards a central position.

Preferably, said other part of the figure includes a saddle which is formed integral with the body and legs of the rider and the shoulders of the horse. Preferably, said other part is bifurcated in the region representing the saddle, the shoulders of the horse and the legs of the rider, so that the body of the horse is movable within the said bifurcated region.

In a second embodiment of the invention, the first portion of the rider is constituted by his arms, head and body, while the second portion of the rider is constituted by his legs. In this case, the pivotal connection between said one part of the figure and said other part is located at the junction between the body and the legs of the rider. All the various modifications of the first embodiment referred to hereinbefore are equally applicable to the second embodiment of the invention.

It is to be understood that said one part of a model figure in accordance with the invention is in the form of a pendulum and that, when the model is at rest, the relative positions of the said one part and said other part represent those normally adopted by a rider sitting on a stationary horse. Acceleration of the said other part in a direction having a component perpendicular to the axis of the pivotal connection between the two parts causes relative angular motion between the two parts as a result of the inertia of said one part. If there is a further pivotal connection between the base and the mounting means, acceleration of the base in a direction having a component perpendicular to the axis of this further pivotal connection will produce angular movement of the said other part of the figure relative to the base as a result of the inertia of said other part. Thus, provided the axes of the two pivotal connections are substantially parallel, acceleration of the base will produce not only angular motion between the said other part of the figure and the base, but also relative angular motion between said one part of the figure and said other part of the figure. By proper design and dimensioning of the two parts, these two relative motions can be arranged to simulate movements of the horse and rider when the horse is walking, trotting or cantering.

If the legs of the horse are freely pivotted to said one part or said other part of the model, movement of the respective part will also result in angular movement of the legs about their respective pivot axes. It has been found that in the case of the hind legs such free pivotal connection produces a sufficiently realistic simulation of the horse's movements. However, to produce equally realistic simulation of the movement of the fore legs, a mechanical coupling must be provided, and in this case the angular movement of the fore legs will be produced by the relative motion between said one part and said other part.

It is to be understood that the acceleration of the base may be produced manually or it may be produced by a clockwork or electric motor. The acceleration may result from reciprocating motion of the base or from intermittent motion in one direction. Normally, the base will be generally flat and will extend longitudinally parallel to the longitudinal extent of the horse. The two pivot axes will then be parallel to the plane of the flat portion of the base and perpendicular to the longitudinal axis of the base. Thus, the intermittent or reciprocating motion required to produce the desired movements of the figure will be in the direction of the longitudinal axis of the base.

Figure 2:
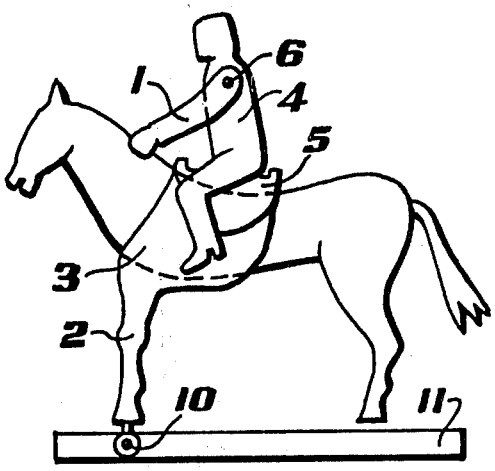
Figure 3:
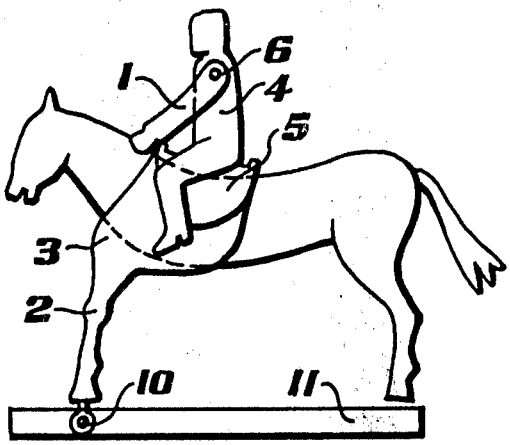
Figure 4:
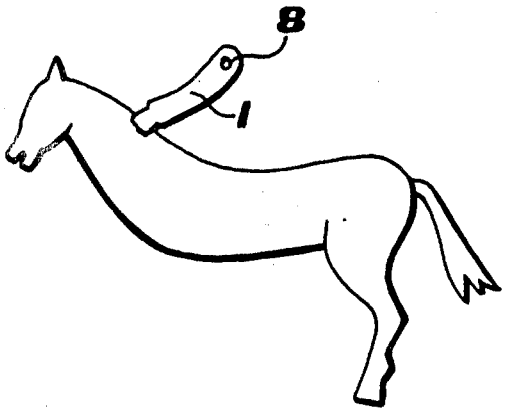
Figure 5:
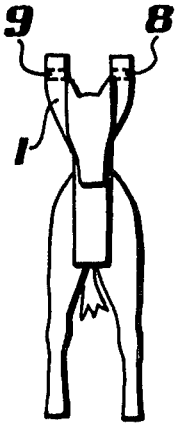
Figure 6:
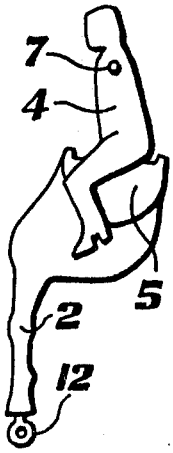
Figure 11:
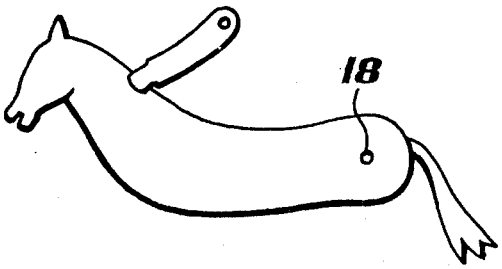
Figure 12:
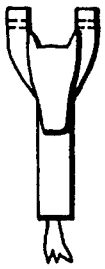
Figure 13:
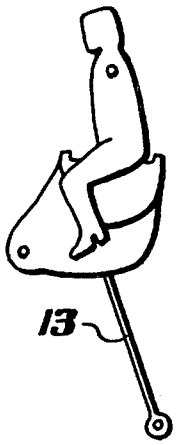
Figure 14:
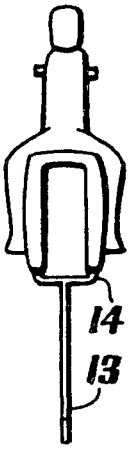
Figure 15:
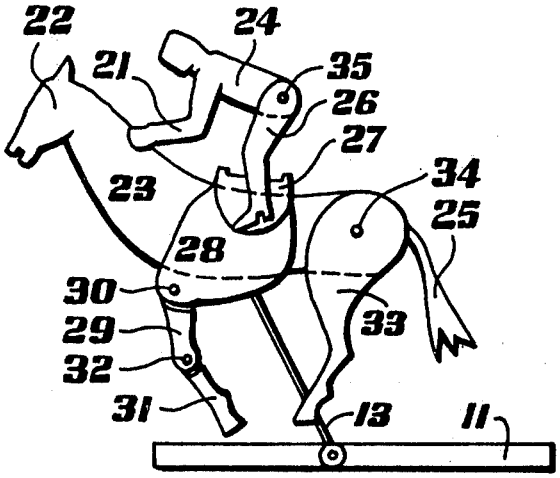
Figure 16:
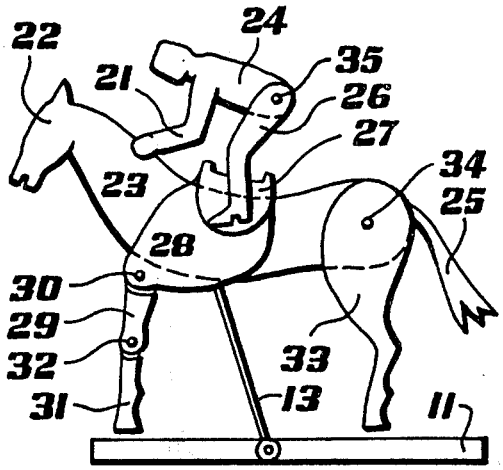
Figure 17:
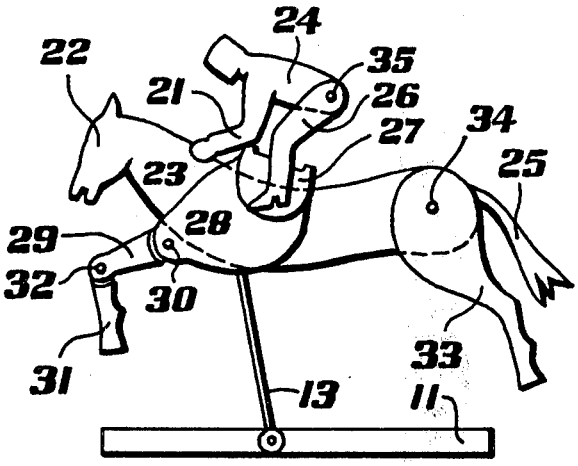
Figure 18:
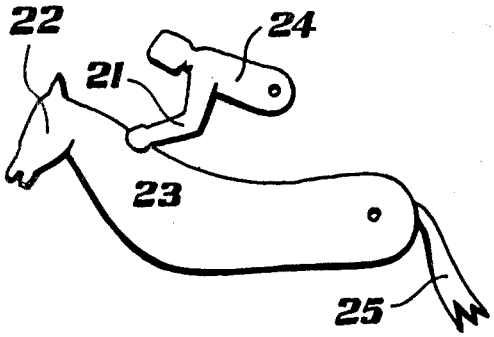
Figure 19:
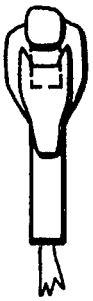
Figure 20:
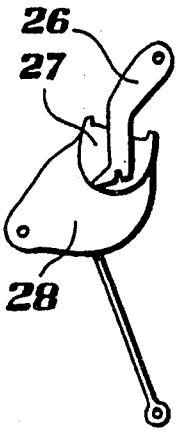
Figure 21:
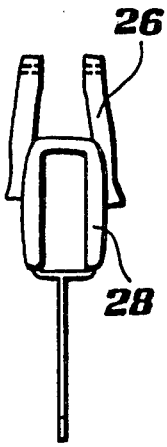
Figure 22:
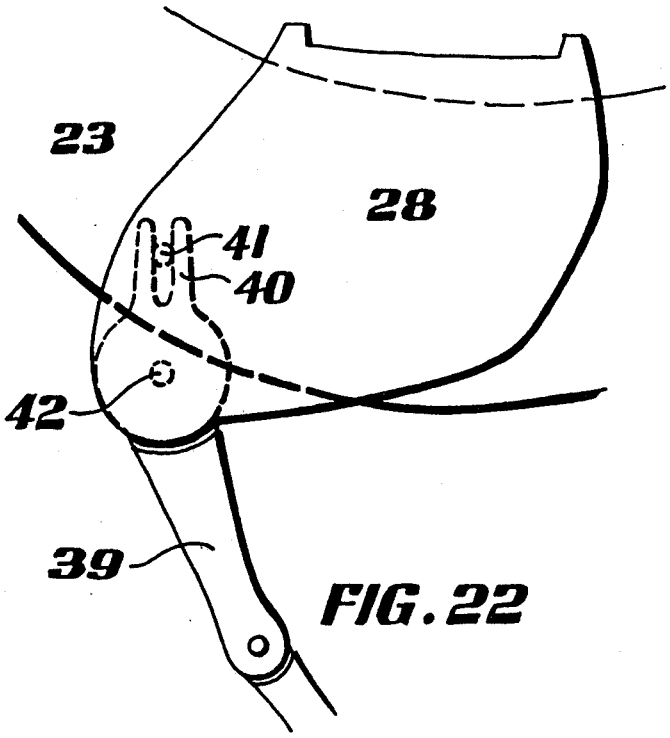
Figure 23:
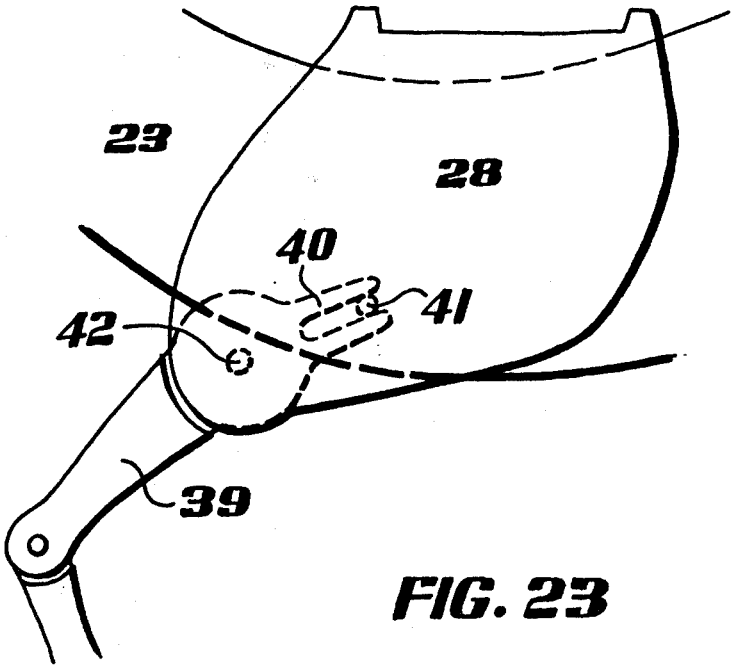
Figure 24:
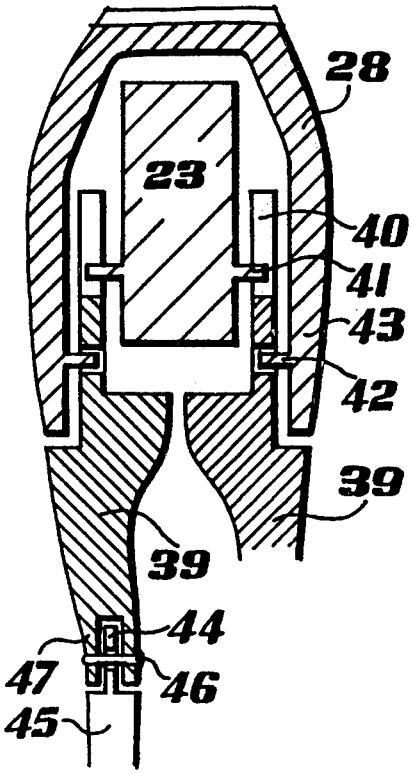

Methods of performing the invention will now be described with reference to the accompanying diagrammatic drawings, in which:

FIGS. 1, 2 and 3 are side views of a first embodiment of the invention illustrating different relative positions between the one and the other parts of the model, FIG. 4 is a side view of the one part of the model illustrated in FIGS. 1, 2 and 3, FIG. 5 is a front view of the part illustrated in FIG. 4, FIG. 6 is a side view of the other part of the model illustrated in FIGS. 1, 2 and 3, FIG. 7 is a front view of the part illustrated in FIG. 5, FIGS. 8, 9 and 10 are side views of a modification of the embodiment of the invention illustrated in FIGS. 1, 2 and 3, FIG. 11 is a side view of the one part of the model illustrated in FIGS. 8, 9 and 10, FIG. 12 is a front view of the part illustrated in FIG. 11, FIG. 13 is a side view of the part of the model illustrated in FIGS. 8, 9 and 10, FIG. 14 is a front view of the part illustrated in FIG. 13, FIGS. 15, 16 and 17 are side views of a second embodiment of the invention illustrating different relative positions of the two parts of the model, FIG. 18 is a side view of the one part of the model illustrated in FIGS. 15, 16 and 17, FIG. 19 is a front view of the part illustrated in FIG. 18, FIG. 20 is a side view of the other part of the model illustrated in FIGS. 15, 16 and 17, FIG. 21 is a front view of the part illustrated in FIG. 20, FIGS. 22 and 23 are side views, on an enlarged scale, of a part of the model illustrated in FIGS. 8 to 14, showing the mechanical coupling between one of the fore legs of the horse and said one part of the model, and FIG. 24 is a cross-sectional view of the part of the model illustrated in FIGS. 22 and 23.

In the embodiment of the invention illustrated in FIGS. 1 to 7, one part of the model is constituted by the arms 1 of the rider, together with the whole of the horse apart from the fore legs 2 and shoulders 3, while the other part of the model is constituted by the body of the rider 4, the saddle 5 and the fore legs 2 and shoulders 3 of the horse. Each of these two parts of the model is formed as an integral unit and the pivotal connection between the one part and the other part is located at the junction 6 between the arms 1 and the body 4 of the rider.

Figure 7:
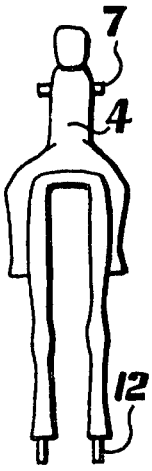

As can be seen from the drawings, and in particular from FIG. 7, the said other part of the model is bifurcated and is dimensioned so that the body of the horse can reciprocate freely within the two branches of the other part.

Normally, a model figure in accordance with the invention will consist of moulded synthetic resin material and in this case the pivotal connection between the two parts of the model may be formed, for example, by providing small studs projecting from the shoulders of the rider as at 7 and engaging in holes 8 and 9 in the respective arms of the rider. The model will be assembled by forcing the arms apart, locating the studs 7 in the holes 8 and 9, and allowing the arms to spring back into position.

A further pivotal connection is provided at 10 between the said other part of the model and a base 11. This pivotal connection may be provided by moulding a ring 12 below each fore hoof of the horse and providing slots in the base 11 to receive these rings. The rings may be held in position in the respective slots by a pin passing laterally through the base and through the holes in the respective rings, or by projecting studs in the slots similar to the studs 7 on the rider's shoulders. Preferably spring means (not shown) are provided to bias the fore legs to the upright position shown in FIG. 2.

FIG. 2 shows the model in the normal rest position and FIG. 3 shows the relative positions of the parts of the model when the base 11 is accelerated in the forward direction. It will be seen that this acceleration causes the fore legs of the horse to rotate in a clockwise direction about the pivotal connection 10, while the arms of the rider rotate in an anticlockwise direction about the pivotal connection 6. When the rate of forward movement of the base 11 is reduced or reversed, the parts of the model move from the relative positions shown in FIG. 3 to the relative positions shown in FIG. 1, passing through the intermediate positions shown in FIG. 2. It will be seen that in this case the fore legs of the horse have rotated in an anticlockwise direction, while the arms of the rider have rotated in a clockwise direction. It can also be seen that these movements cause the fore and hind legs of the horse to be extended apart when the parts are in the relative positions shown in FIG. 3 and to be relatively close together when the parts are in the relative positions shown in FIG. 1.

The modification illustrated in FIGS. 8 to 14 is similar to the embodiment illustrated in FIGS. 1 to 7, except that the horse's hind and fore legs are pivotally attached respectively to the said one and the said other part of the model. With this arrangement, it is not possible to use the fore legs as the means of mounting the figure on the base and accordingly a separate mounting rod 13 is provided. This rod is rigidly attached to the two branches of the bifurcated part of the model as shown at 14 in FIG. 14. The lower end of the rod is pivotally connected to the base 11, for example, in the same way as the fore legs in the embodiment illustrated in FIGS. 1 to 7. Alternatively, the rod may be in the form of a spring and in this case the lower end of the rod may be fixed rigidly in the base.

The fore legs of the horse in the embodiment illustrated in FIGS. 8 to 14 are pivotally attached to the shoulders of the horse as shown at 15. In addition, a further pivotal connection is provided at the knee of the horse as shown at 16. The hind legs 17 of the horse are pivotally connected to the body at 18. The pivotal connections of the hind legs are free and it will be seen that they provide relative movements of the hind legs additional to the relative movements of the two parts of the model described with reference to the embodiment illustrated in FIGS. 1 to 7. The motion of the fore legs of the horse about the pivotal connection 15 is controlled by a mechanical coupling between the forearms 19 and the said one part of the horse. It can be seen from FIG. 10 that when the base is accelerated in the forward direction, so that said one part of the model rotates in an anticlockwise direction about the shoulder pivot 6, the fore arms of the horse are constrained by the mechanical coupling to rotate in a clockwise direction about the pivot 15, while the parts of the fore legs below the knees rotate anticlockwise about the pivots 16. The acceleration of the base also causes the hind legs 17 to rotate freely in an anticlockwise direction about the pivot 18 and these movements of the fore and hind legs together simulate the extension of the horse's legs in a canter.

Figure 8:
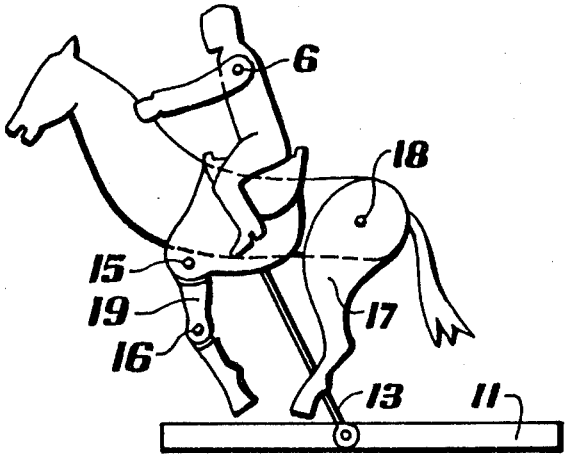
Figure 9:
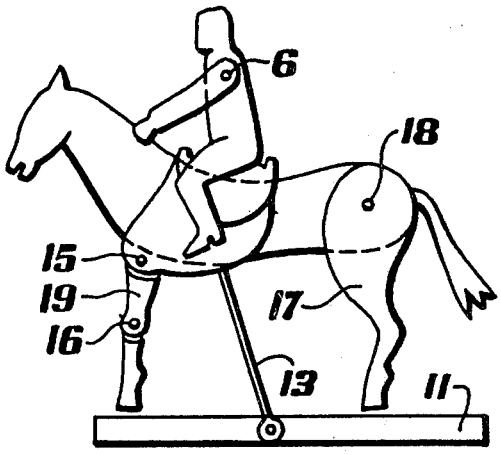
Figure 10:
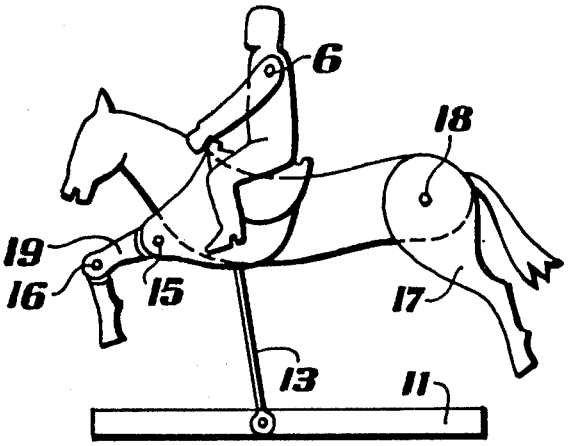

FIG. 8, on the other hand, shows how the fore and hind legs move together when acceleration of the model is in the rearward direction, the rotation of the fore legs being brought about by the clockwise rotation of the horse's body about the pivot 6, and the rotation of the hind legs being brought about by the pendulum action of the legs themselves.

The embodiment of the invention illustrated in FIGS. 15 to 21 is generally similar to that illustrated in FIGS. 8 to 14, except that the said one part of the model is constituted by the arms 21 and the body 24 of the rider, together with the head 22, body 23 and tail 25 of the horse, while the other part of the model is constituted by the legs 26 of the rider, together with the saddle 27 and the shoulders 28 of the horse. The forearms 29 of the horse are pivotally attached to the shoulders at 30, while the lower parts of the fore legs 31 are pivotally attached to the forearms at 32. The hind legs 33 are pivotally attached to the body 23 at 34.

In this embodiment, the pivotal connection between the one part and the other part of the model is located at the junction 35 between the body 24 and the legs 26 of the rider. As in the case of the embodiment illustrated in FIGS. 8 to 14, the model is mounted on the base 11 by means of a rod 13. The relative movements resulting from the various pivotal connections are similar to those described with reference to FIGS. 8 to 14, except that the attitude of the rider resembles that of a racing jockey.

Both of the embodiments illustrated in FIGS. 8 to 14 and FIGS. 15 to 21 include the mechanical couplings shown in FIGS. 22 to 24 for producing predetermined movements of the fore legs in dependence on the relative movements of the one part and the other part of the figure. As shown, each forearm 39 is provided with an upward slotted extension 40. Two studs 41 are moulded in the body 23 of the horse and each stud is slidable as well as rotatable in a respective one of the slotted extensions 40. Since each forearm 39 is pivotally connected to the portion 28 by studs 42 which project inwardly from the bifurcated parts 43 which represent the shoulders of the horse, relative movement between the portions 23 and 28 produces controlled rotation of the forearms 39 about the studs 42.

In addition to showing the pivotal connections between the fore legs and the shoulders of the horse, FIG. 24 also shows one way in which one of the lower legs 45 may be pivotally connected to the respective forearm 39. This latter pivotal connection is constituted by a ring-like extension 44 on the upper extremity of the lower leg 45 and a pin 46 extending between the two branches of a bifurcated portion 47 representing the knee of the horse at the lower extremity of the forearm 39.

What is claimed is:

1. A model figure of a horse and rider, comprising:

(a) a first part, the first part being defined by a first portion of the rider and a first portion of the horse, the first portion of the rider including the arms of the rider, the first portion of the horse including the head and body of the horse, (b) a second part pivotally connected to the first part, the second part being defined by a second portion of the rider and a second portion of the horse, and wherein the sole pivotal connection between the first and second parts is at the junction between the first and second portions of the rider.

* * * * *